US009004948B2

(12) United States Patent
Tsai

(10) Patent No.: US 9,004,948 B2
(45) Date of Patent: Apr. 14, 2015

(54) END CAP OF A LIGHTING TUBE

(71) Applicant: Lextar Electronics Corporation, Hsinchu (TW)

(72) Inventor: Ming-Hua Tsai, Chiayi (TW)

(73) Assignee: Lextar Electronics Corporation, Hsinchu (TW)

( * ) Notice: Subject to any disclaimer, the term of this patent is extended or adjusted under 35 U.S.C. 154(b) by 56 days.

(21) Appl. No.: 14/010,704

(22) Filed: Aug. 27, 2013

(65) Prior Publication Data

US 2014/0098527 A1 Apr. 10, 2014

(30) Foreign Application Priority Data

Oct. 5, 2012 (TW) ..... 101136921 A

(51) Int. Cl.

| | |
|---|---|
| ***H01J 5/56*** | (2006.01) |
| ***F21V 21/14*** | (2006.01) |
| ***F21K 99/00*** | (2010.01) |
| *F21Y 101/02* | (2006.01) |

(52) U.S. Cl.

CPC ..... *F21V 21/14* (2013.01); *F21K 9/175* (2013.01); *F21K 9/58* (2013.01); *F21Y 2101/02* (2013.01)

(58) Field of Classification Search

USPC ..... 439/611, 612, 617, 619; 313/318.02, 313/318.05

See application file for complete search history.

(56) References Cited

U.S. PATENT DOCUMENTS

| | | | | |
|---|---|---|---|---|
| 4,878,854 | A * | 11/1989 | Cannon | 439/236 |
| 5,489,813 | A * | 2/1996 | Jung | 313/25 |
| 5,904,415 | A * | 5/1999 | Robertson et al. | 362/260 |
| 6,515,412 | B1 * | 2/2003 | Ishitsuka et al. | 313/491 |
| 7,275,854 | B2 * | 10/2007 | Dorleijn et al. | 362/649 |
| 7,619,352 | B2 * | 11/2009 | Jeurissen et al. | 313/485 |
| 8,118,447 | B2 * | 2/2012 | Simon et al. | 362/235 |
| 8,308,497 | B2 * | 11/2012 | Zayas et al. | 439/236 |
| 8,313,348 | B2 * | 11/2012 | Mertens et al. | 439/619 |
| 8,556,454 | B2 * | 10/2013 | Pei et al. | 362/221 |
| 2010/0015843 | A1 * | 1/2010 | Zayas et al. | 439/375 |
| 2010/0277918 | A1 * | 11/2010 | Chen et al. | 362/249.02 |
| 2010/0317212 | A1 * | 12/2010 | Daily | 439/230 |
| 2012/0099322 | A1 * | 4/2012 | Simon et al. | 362/249.02 |
| 2014/0009925 | A1 * | 1/2014 | Verhoeven et al. | 362/221 |
| 2014/0029247 | A1 * | 1/2014 | Gielen et al. | 362/217.13 |
| 2014/0098527 | A1 * | 4/2014 | Tsai | 362/220 |
| 2014/0226321 | A1 * | 8/2014 | Halliwell et al. | 362/217.08 |

FOREIGN PATENT DOCUMENTS

| | | |
|---|---|---|
| TW | M414788 | 10/2011 |
| TW | M423192 | 2/2012 |

* cited by examiner

*Primary Examiner* — Ross Gushi
(74) *Attorney, Agent, or Firm* — Moser Taboada

(57) ABSTRACT

An end cap of a lighting tube includes a first assembly member and a second assembly member. The first assembly member includes a first shell, several recesses, and two first position-limiting elements. The first shell has a first central-securing element, and the first shell forms a first area and a second area. The two first position-limiting elements are disposed on the first area. The second assembly member includes a second shell, a first elastic element, a second elastic element, and two positioning elements. An end of the second shell is connected to a lighting tube and a second central-securing element of the second shell is secured with the first central-securing element. The first elastic element is disposed on the second shell. The second elastic element is disposed on the second shell. The two positioning elements are disposed on the second shell.

12 Claims, 8 Drawing Sheets

END CAP OF A LIGHTING TUBE

RELATED APPLICATIONS

This application claims priority to Taiwan Application Serial Number 101136921, filed Oct. 5, 2012, which is herein incorporated by reference.

BACKGROUND

1. Field of Invention

The present invention relates to an end cap. More particularly, the present invention relates to an end cap of a lighting tube.

2. Description of Related Art

Light-emitting diodes (LEDs) have many advantages such as high efficiency and long life. Therefore, traditional fluorescent tubes are gradually being replaced by LEDs.

LEDs produce heat and high temperature during the conversion of electricity into light. When the temperature rises, the lighting efficiency and life span of light-emitting diodes decrease. Thus, there is a need to provide a heat sink in an LED lighting tube. However, such a heat sink may limit the lighting angle of the LED lighting tube so that the LED lighting tube cannot emit light in all directions (i.e., 360 degrees) like the mercury lighting tube.

Thus, a rotatable LED lighting tube that allows for adjustments in the lighting direction has been developed and offered on the market. However, such a rotatable LED lighting tube includes several complex components to allow rotation of the LED lighting tube. Therefore, the rotatable LED lighting tube has several problems such as high cost and complex assembly.

When a manufacturer produces both rotatable lighting tubes and the fixed lighting tubes, the manufacturer has to design and make two kinds of conventional end caps to be respectively secured with the rotatable lighting tubes and the fixed lighting tubes. Thus, the manufacturer must invest much time and effort into producing the two kinds of the conventional end caps, as they cannot be interchangeably used by the rotatable lighting tubes and the fixed lighting tubes. One consequence of this is the increased storage associated with having to stock two different types of end caps.

Therefore, there is a need to develop an end cap that is capable of avoiding the foregoing disadvantages.

SUMMARY

In accordance with the present invention, an end cap of a lighting tube includes a first assembly member and a second assembly member. The first assembly member includes a first shell, several recesses, and two first position-limiting elements. The first shell has a first central-securing element, and an annular inner wall of the first shell forms a first area and a second area. The recesses are formed in the first area of the annular inner wall of the first shell, and an angle formed between two lines each formed from one of two opposite ends of the first area to an axis of the first shell is less than 180°. The two first position-limiting elements are disposed on the two ends of the first area. The second assembly member includes a second shell, a first elastic element, a second elastic element, and two positioning elements. One end of the second shell is connected to a lighting tube, and the other end of the second shell has a second central-securing element that is secured with the first central-securing element such that the first central-securing element is capable of rotating relative to the second central-securing element. The first elastic element is disposed on the second shell, and the first elastic element has a first protrusion that is received in one of the recesses. The second elastic element is disposed on the second shell, and the second elastic element has a second protrusion that is abutted against one of the recesses. The two positioning elements are disposed on the second shell, and the two positioning elements and the first elastic element are respectively disposed on the two opposite sides of the second central-securing element.

According to another embodiment disclosed herein, the angle formed between the two lines each formed from one of the two opposite ends of the first area to the axis of the first shell is 135°.

According to another embodiment disclosed herein, the first central-securing element has a first hook portion and the second central-securing element has a second hook portion, and the first hook portion is secured with the second hook portion such that the first central-securing element is rotatably secured with the second central-securing element.

According to another embodiment disclosed herein, the second elastic element is located between the two positioning elements.

According to another embodiment disclosed herein, a vertical height of each of the positioning elements is greater than a vertical height of the first elastic element and a vertical height of the second elastic element.

According to another embodiment disclosed herein, the vertical height of the first elastic element is equal to the vertical height of the second elastic element.

According to another embodiment disclosed herein, a gap is formed between the first elastic element and one of the two first position-limiting elements when the first assembly member is secured with the second assembly member and the first elastic element is aligned with the one of the two first position-limiting elements.

According to another embodiment disclosed herein, the first assembly member has two second position-limiting elements, and one of the two positioning elements is abutted against one of the two second position-limiting elements to restrict rotation of the first assembly member relative to the second assembly member about a direction when the first protrusion is received in one of the recesses located on the two opposite ends of the first area.

According to another embodiment disclosed herein, the first shell has an opening, and the maximum vertical distance between one of the recesses and the opening is less than the minimum vertical distance between one of the first position-limiting elements and the opening.

According to another embodiment disclosed herein, when the first assembly member is secured with the second assembly member and the two positioning elements are abutted against the second position-limiting elements, the first assembly member is locked in the second assembly member such that the first assembly member cannot rotate relative to the second assembly member.

According to another embodiment disclosed herein, a rotating angle of the first assembly member rotates relative to the second assembly member is less than or equal to 180° when the first assembly member is secured with the second assembly member and the two positioning elements are located in the second area.

According to another embodiment disclosed herein, the rotating angle of the first assembly member rotates relative to the second assembly member is more than 180° when the first assembly member is secured with the second assembly member and the two positioning elements are located in the second area.

The end cap may be applied to a rotatable end cap or a fixed end cap when the first assembly member is secured with the second assembly member in different ways. Therefore, the end cap can be applied to a rotatable lighting tube or a fixed lighting tube. In addition, the cost of producing the end cap and the assembly complexity of the end cap may be reduced because the first assembly member and the second assembly member have fewer components.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
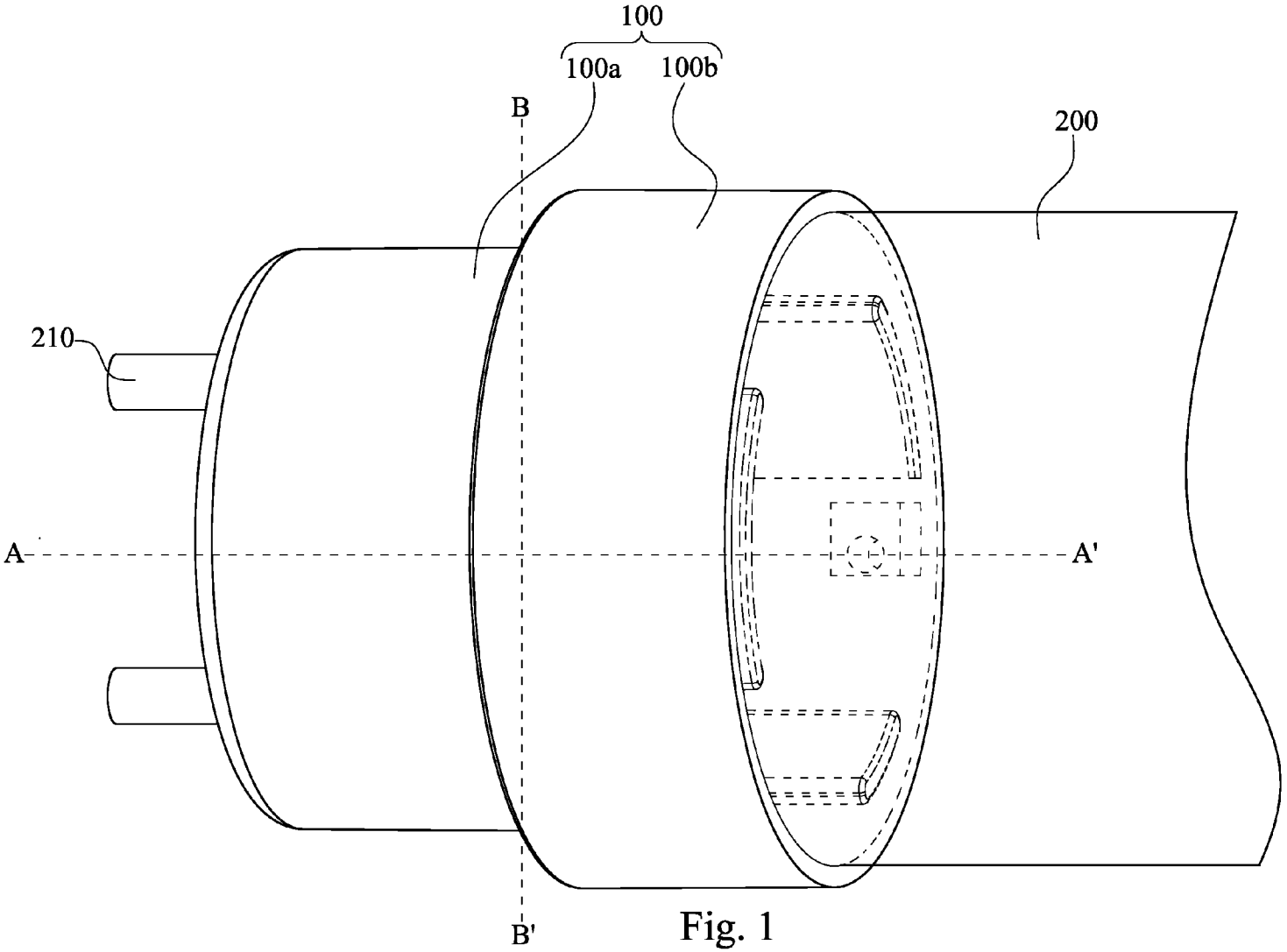
FIG. 1 illustrates a side view of an end cap secured with a lighting tube according to an embodiment of the present invention.

FIG. 1 shows a side view of an end cap 100 secured with a lighting tube 200 according to an embodiment of the present invention. An end of a lighting tube 200 is inserted into the end cap 100 such that the lighting tube 200 is secured with the end cap 100. After a connecting terminal 210 is extended through the end cap 100 and electrically connected to an external power source, the lighting tube 200 may operate to emit light using the electric power from the external power source. In this embodiment, a first assembly member 100*a* is secured with a second assembly member 100*b* to form the end cap 100. Because the lighting tube 200 is a cylindrical lighting tube, a configuration of the second assembly member 100*b* needs to be cylindrical such that the second assembly member 100*b* may be secured with the lighting tube 200. In addition, a configuration of the first assembly member 100*a* also needs to be cylindrical such that the first assembly member 100*a* may be secured with the second assembly member 100*b*.

Figure 2:
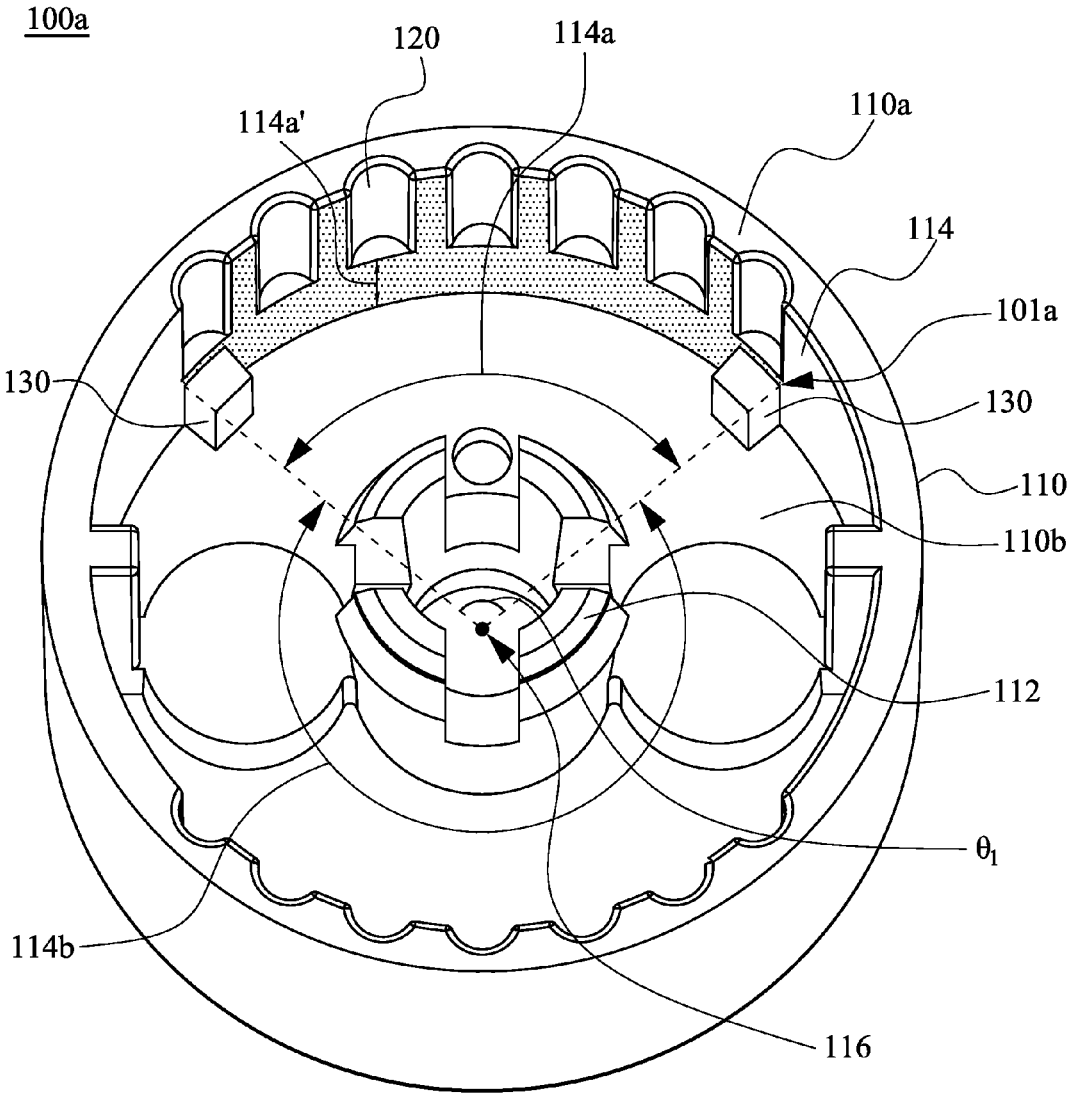
FIG. 2 illustrates a perspective view of a first assembly member of the end cap of FIG. 1.

FIG. 2 shows a perspective view of the first assembly member 100*a* of the end cap 100 of FIG. 1. The first assembly member 100*a* has a first shell 110 and several recesses 120 formed in an annular inner wall 114 of the first shell 110, in which the recesses 120 may be equally spaced apart along the annular inner wall 114 of the first shell 110. In addition, the first shell 110 has a first surface 110*a* and a second surface 110*b*, and two first position-limiting elements 130 are disposed on a surface of the annular inner wall 114 of the first shell 110, in which each of the first position-limiting elements 130 is disposed on the annular inner wall 114 near the second surface 110*b* of the first shell 110.

The first shell 110 has a first central-securing element 112 formed around an axis 116 of the first shell 110. That is, the central-securing element 112 is vertically extended outward from the second surface 110*b* of the first shell 110 about the axis 116 of the first shell 110. In addition, a first area 114*a* and a second area 114*b* are formed on the annular inner wall 114 of the first shell 110. The recesses 120 are formed in the first area 114*a* of the annular inner wall 114, in which each of the recesses 120 is recessed inward in the first area 114*a* of the annular inner wall 114 and extended in a direction from the first surface 110*a* toward the second surface 110*b*. The recesses 120 may appear as several semi-circular gaps located on the first surface 110*a* when viewed from above, and each of the recesses 120 is formed in a semi-cylindrical hollow configuration when seen from an angle allowing full view of the length thereof. In addition, a space 114*a*' is formed between each of the recesses 120 and the second surface 110*b*. In this embodiment, an angle $\theta_1$ of less than 180° is formed between lines that each interconnects one of the ends of the first area 114*a* and the axis 116 of the first shell 110. In other embodiments, the angle $\theta_1$ that is formed between the lines that each interconnects one of the ends of the first area 114*a* and the axis 116 of the first shell 110 is 135°.

The first position-limiting elements 130 are disposed at the two ends of the first area 114*a* of the annular inner wall 114 near the second surface 110*b*, in which a height of each of the first position-limiting elements 130 is less than the space 114*a*' between each of the recesses 120 and the second surface 110*b*. In other words, intervals 101*a* are formed between the first position-limiting elements 130 and the recesses 120 that are aligned with the first position-limiting element 130.

In this embodiment, the recesses 120 are disposed in the first area 114*a*, as well as in a portion of the second area 114*b* that is opposite to the first area 114*a*. In another embodiment, the recesses 120 may be disposed along the entire the annular inner wall 114 of the first shell 110. In this embodiment, the first position-limiting elements 130 are disposed in the first area 114, but the present invention is not limited in this regard.

Figure 3:
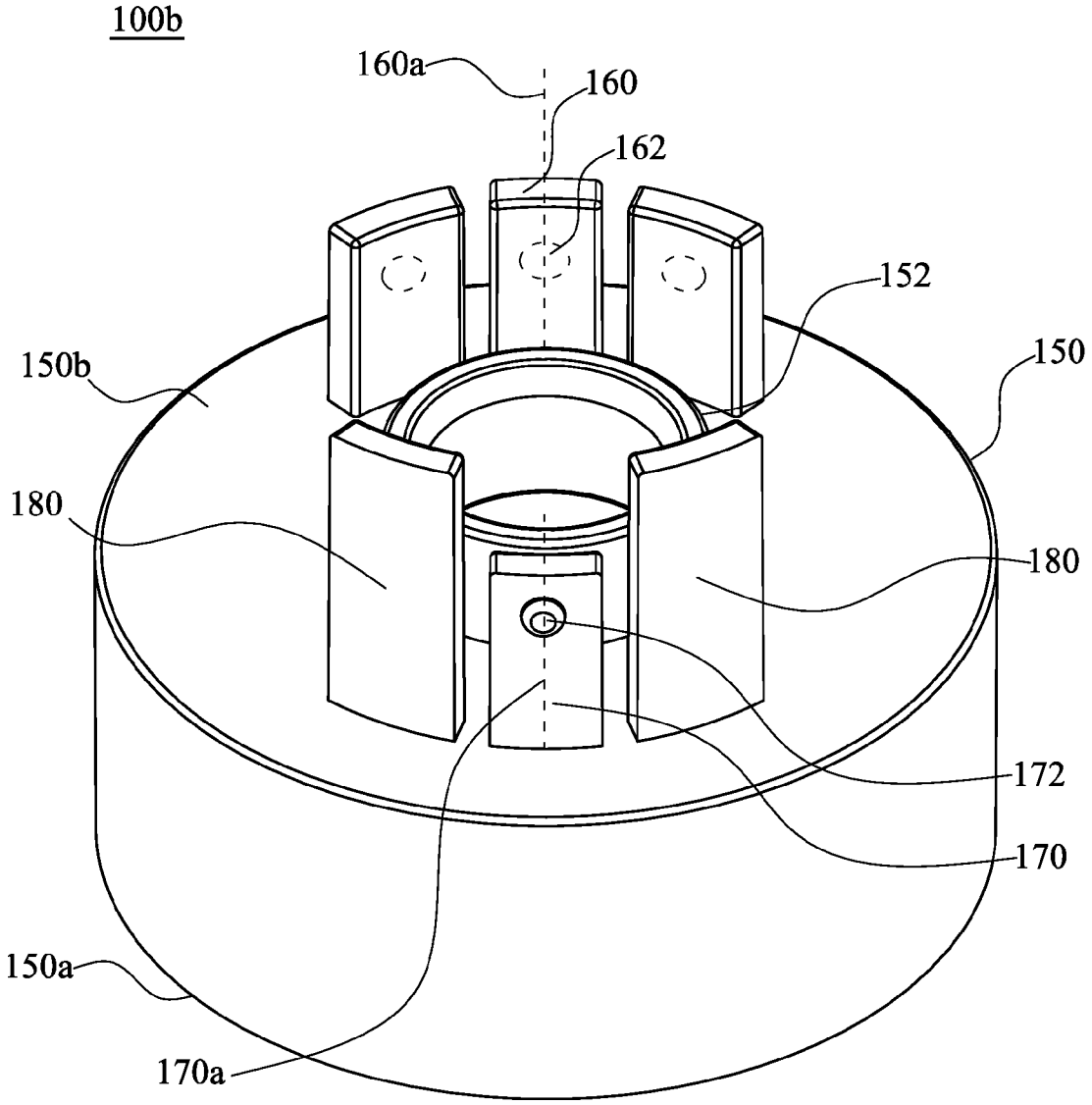
FIG. 3 illustrates a perspective view of a second assembly member of the end cap of FIG. 1.

FIG. 3 shows a perspective view of the second assembly member 100*b* of the end cap 100 of FIG. 1. The second assembly member 100*b* is secured with the first assembly member 100*a* to form the end cap 100, as described above. The second assembly member 100*b* includes a second shell 150, several first elastic elements 160, a second elastic element 170, and two positioning elements 180. In this embodiment, the number of the first elastic elements 160 is three. In another embodiment, the number of the first elastic element 160 may be at least one.

An end 150*a* of the second shell 150 is used for being connected to the lighting tube 200 (see FIG. 1). A second central-securing element 152 is formed about an axis of an opposite end 150*b* of the second shell 150. The first central-securing element 112 is rotatably secured with the second central-securing element 152 (see FIG. 2).

The first elastic elements 160 are disposed on the second shell 150 and located on the same end 150*b* of the second shell 150 on which the second central-securing element 152 is located. The first elastic elements 160 are disposed outwardly from the second central-securing element 152. In this embodiment, each of the first elastic elements 160 is a rectangular plate. In another embodiment, each of the first elastic elements 160 may be a plate having another shape. Each of the first elastic elements 160 has a first protrusion 162. Each of the first protrusions 162 is a bump-like structure formed on an outer wall of the corresponding first elastic element 160. When the first assembly member 100*a* is secured with the second assembly member 100*b*, each of the first protrusions 162 may be received in one of the recesses 120 (see FIG. 2). In this embodiment, the first protrusions 162 are circular bump-like structures disposed on the outer wall of the first elastic elements 160 such that each of the first protrusions 162 may be smoothly slipped into and out of one of the recesses 120. In this embodiment, each of the first protrusions 162 is located on an outer surface of an end of one of the first elastic elements 160 at a distance from the second shell 150, and on a central axis 160*a* of the one of the first elastic elements 160.

In this embodiment, the second elastic element 170 is disposed on the second shell 150 and located on the same end 150*b* of the second shell 150 on which the second central-securing element 152 is disposed. The second elastic element 170 is disposed outwardly from the second central-securing element 152. In this embodiment, the second elastic element 170 is a rectangular plate. In another embodiment, the second elastic elements 170 may be a plate having another shape. The second elastic element 170 has a second protrusion 172. The second protrusion 172 is a bump-like structure formed on an outer wall of the second elastic element 170. When the first assembly member 100*a* is secured with the second assembly member 100*b*, the second protrusion 172 may be received in one of the recesses 120 to strengthen the assembly stability after the first assembly member 100*a* is secured with the second assembly member 100*b* (see FIG. 1 and FIG. 2). In this embodiment, the second protrusion 172 is a circular bump-like structure disposed on the outer wall of the second elastic element 170 such that the second protrusion 172 may be smoothly slipped into and out of one of the recesses 120. In this embodiment, the second protrusion 172 is located on an outer surface of an end of the second elastic element 170 at a distance from the second shell 150, and on a central axis 170*a* of the second elastic element 170. In this embodiment, the center first elastic element 160 (i.e., the first elastic element 160 at the center of the other two first elastic elements 160) and the second elastic element 170 are disposed on two opposite sides of the second central-securing element 152.

The two positioning elements 180 are disposed on the second shell 150 and also located on the same end 150*b* of the second shell 150 on which the second central-securing element 152 is located. The two positioning elements 180 are disposed outwardly from the second central-securing element 152 and in a manner such that the second elastic element 170 is located between the two positioning elements 180. The two positioning elements 180 and the first elastic elements 160 are respectively disposed on two opposite sides of the second central-securing element 152. In addition, a vertical height of each of the positioning elements 180 is greater than a vertical height of the first elastic elements 160 and a vertical height of the second elastic element 170. In this embodiment, each of the two positioning elements 180 is a rectangular plate. In another embodiment, each of the two positioning elements 180 may be a plate having another shape as long as the vertical height of each of the positioning elements 180 is greater than the vertical height of the first elastic elements 160 and the vertical height of the second elastic element 170.

In this embodiment, the number of the first elastic elements 160 is three and the number of the second elastic element 170 is one, but the present invention is not limited in this regard. Moreover, in this embodiment, the vertical height of the first elastic elements 160 and the vertical height of the second elastic element 170 are the same. In another embodiment, the vertical height of the first elastic elements 160 may be different from the vertical height of the second elastic element 170.

Figure 4:
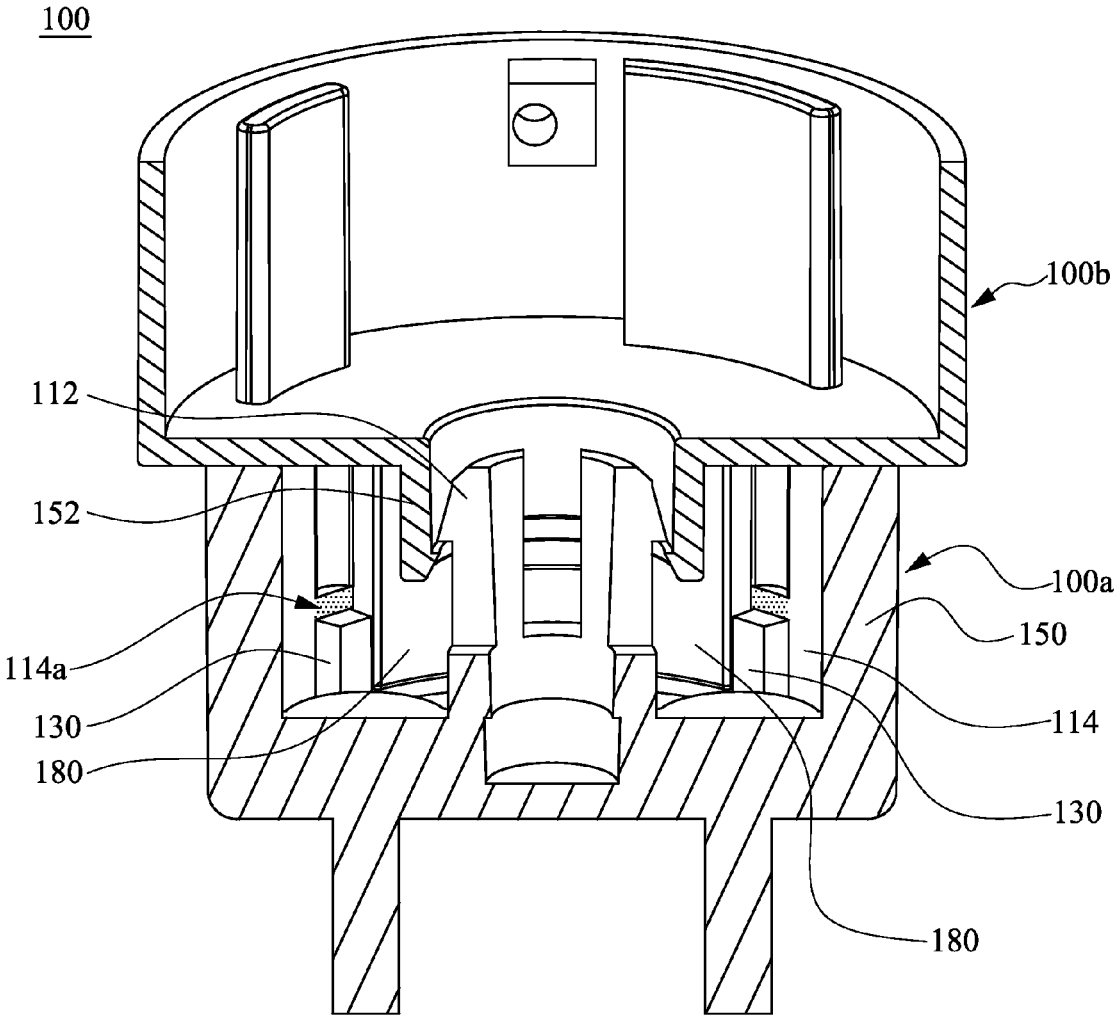
FIG. 4 illustrates a cross-sectional view of the end cap assembled using a first assembly configuration taken along line A-A' of FIG. 1.
Figure 5:
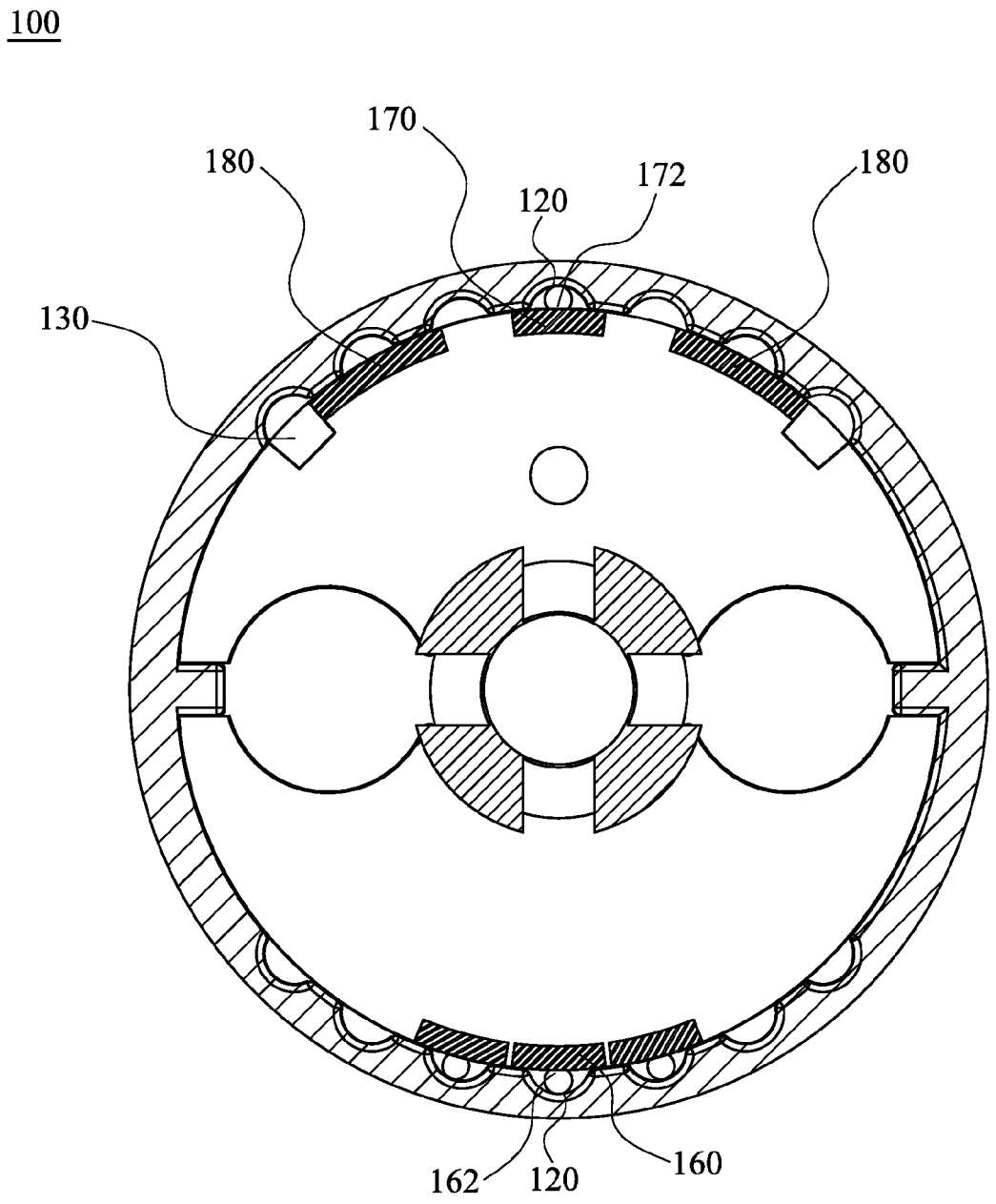
FIG. 5 illustrates a cross-sectional view of the end cap assembled using the first assembly configuration taken along line B-B' of FIG. 1.

FIG. 4 shows a cross-sectional view of the end cap 100 assembled using a first assembly configuration taken along line A-A' of FIG. 1, and FIG. 5 shows a cross-sectional view of the end cap 100 assembled using the first assembly configuration taken along line B-B' of FIG. 1. The first assembly member 100*a* is secured with the second assembly member 100*b* to form the end cap 100 when the first central-securing element 112 is secured with the second central-securing element 152 and the two positioning elements 180 are both located in the first area 114*a*. The vertical height of each of the positioning elements 180 is greater than the vertical height of the first elastic elements 160 and the vertical height of the second elastic element 170, and moreover, the vertical height of each of the positioning elements 180 is greater than a vertical height of the recesses 120 that are secured with the first elastic elements 160 or the second elastic element 170. When the first assembly member 100*a* is secured with the second assembly member 100*b* and the two positioning elements 180 are abutted against the second position-limiting elements 130, the first assembly member 100*a* is locked in the second assembly member 100*b* such that the first assembly member 100*a* cannot rotate relative to the second assembly member 100*b*. In other words, when the first assembly member 100*a* is secured with the second assembly member 100*b* and the two positioning elements 180 are abutted against the two second position-limiting elements 130, the first assembly member 100*a* is locked in the second assembly member 100*b* such that the first assembly member 100*a* cannot rotate relative to the second assembly member 100*b* to form a fixed end cap.

In addition, when the first assembly member 100*a* is secured with the second assembly member 100*b*, the first elastic elements 160 are disposed adjacent to an equal number of the recesses 120 and the first protrusions 162 of the first elastic elements 160 are received in these recesses 120 for strengthening the assembly stability between the first assembly member 100*a* and the second assembly member 100*b*. Moreover, the second elastic element 170 is disposed adjacent to one of the recesses 120 and the second protrusion 172 of the second elastic element 170 is received in the one of the recesses 120 for strengthening the assembly stability between the first assembly member 100*a* and the second assembly member 100*b*. Therefore, when the first assembly member 100*a* is secured with the second assembly member 100*b* and the two positioning elements 180 are located in the first area 114*a*, the first assembly member 100*a* is secured with the second assembly member 100*b* to form the end cap 100 having a strong securing stability, and in addition, the end cap 100 is not rotatable because the first protrusions 162 of the first elastic elements 160 and the second protrusion 172 of the second elastic element 170 are received in the recesses 120.

Figure 6:
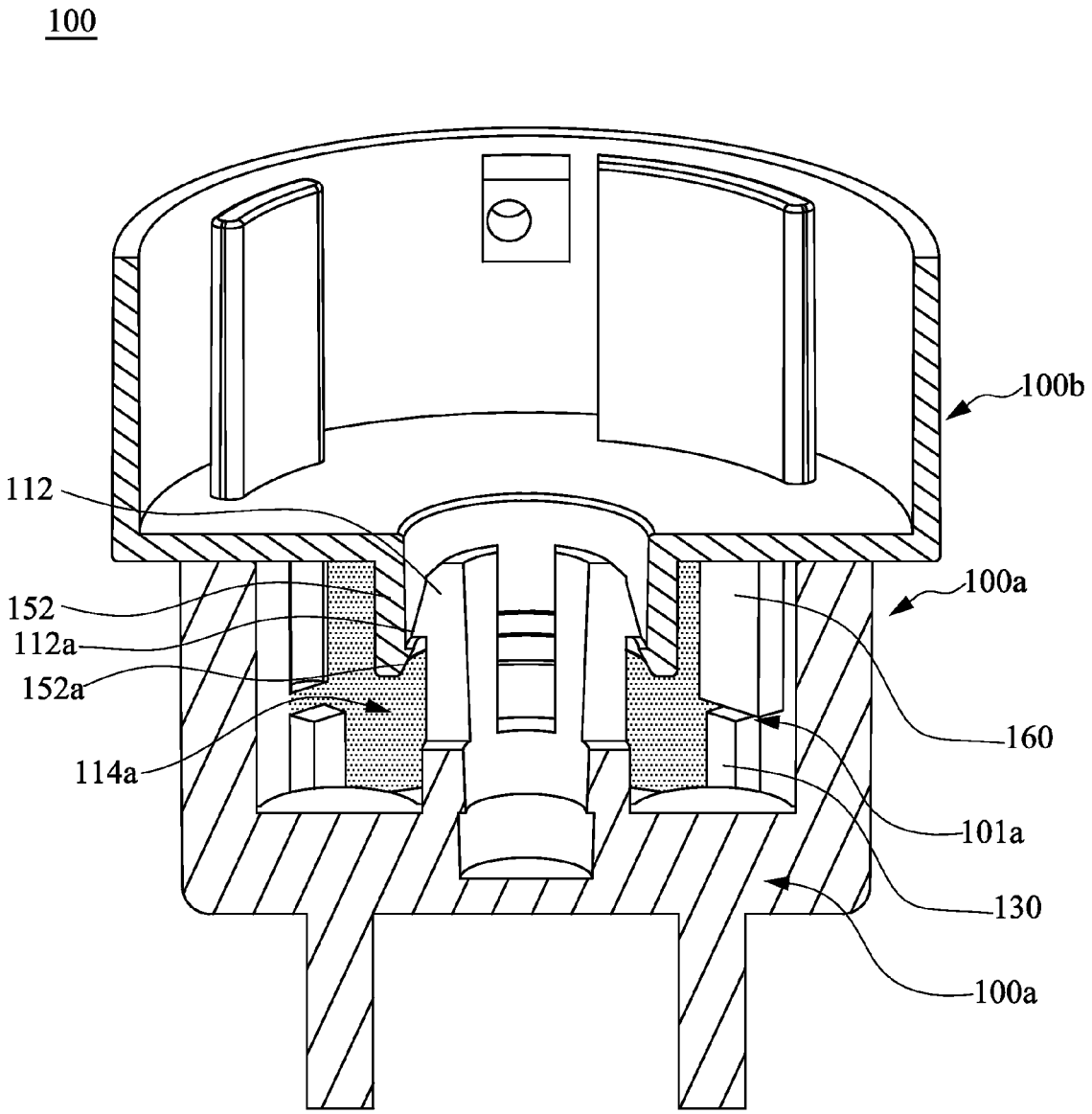
FIG. 6 illustrates a cross-sectional view of the end cap assembled using a second assembly configuration taken along line A-A' of FIG. 1.

FIG. 6 shows a cross-sectional view of the end cap 100 assembled using a second assembly configuration taken along line A-A' of FIG. 1. When the first assembly member 100*a* is secured with the second assembly member 100*b* and the two positioning elements 180 (see FIG. 4) are not both located in the first area 114*a*, a first hook portion 112*a* of the first central-securing element 112 is secured with a second hook portion 152*a* of the second central-securing element 152 such that the first central-securing element 112 is rotatably secured with the second central-securing element 152. Therefore, when the two positioning elements 180 (see FIG. 4) are not simultaneously locked by the position-limiting elements 130, the first assembly member 100*a* is rotatably secured with the second assembly member 100*b*.

When the first assembly member 100*a* is secured with the second assembly member 100*b* and any one of the first elastic elements 160 is aligned with one of the two first position-limiting elements 130, a gap 101*a* is formed between the any of the first elastic elements 160 and the one of the two first position-limiting elements 130. In other words, when the first assembly member 100*a* rotates relative to the second assembly member 100*b*, there is no interference between the first elastic elements 160 and the first position-limiting elements 130.

Figure 7:
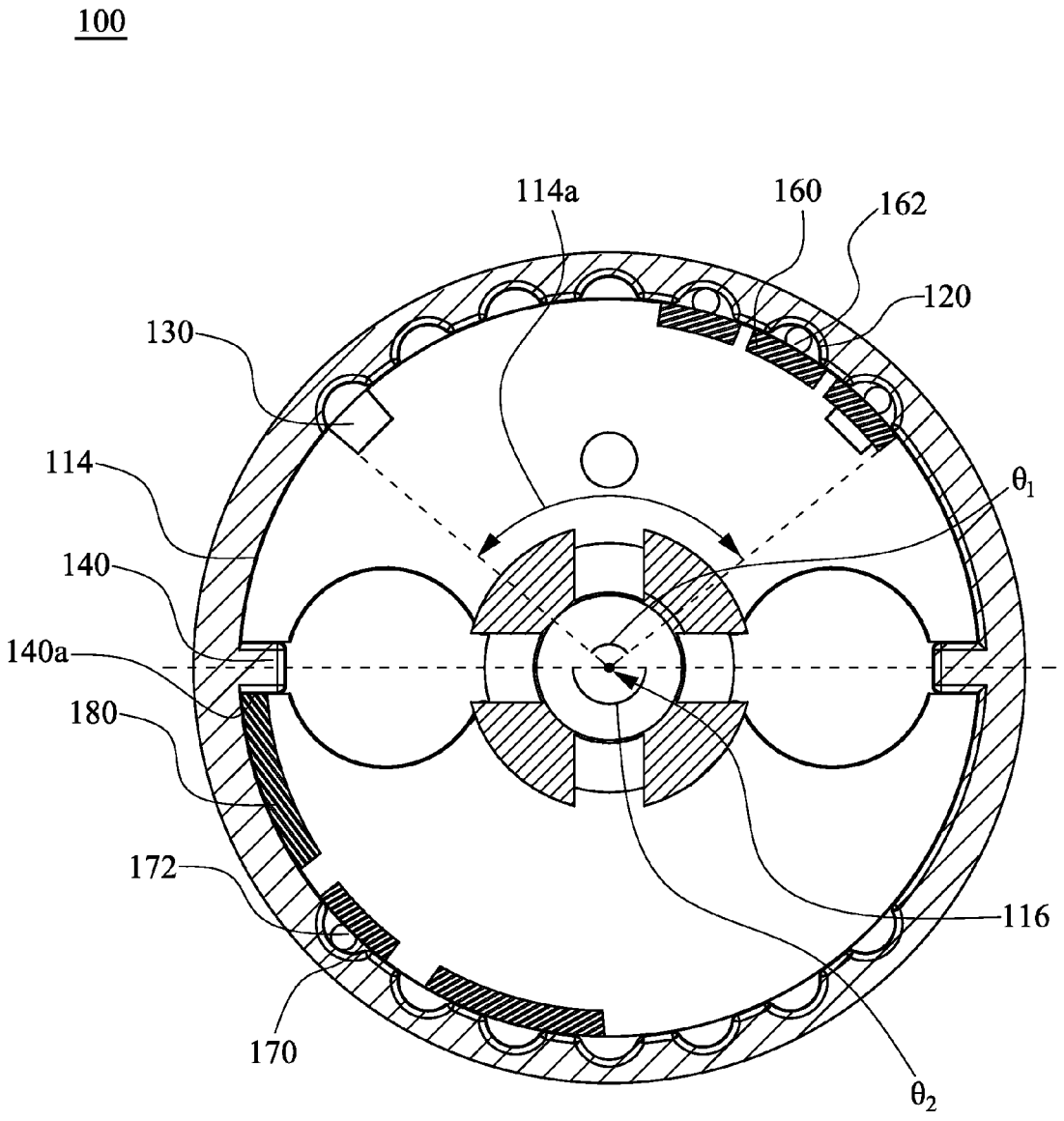
FIG. 7 illustrates a cross-sectional view of the end cap assembled using the second assembly configuration taken along line B-B' of FIG. 1.

FIG. 7 shows a cross-sectional view of the end cap assembled using the second assembly configuration taken along line B-B' of FIG. 1. The first assembly member 100*a* has two second position-limiting elements 140. The two second position-limiting elements 140 are disposed on two opposite sides of the annular inner wall 114 of the first shell 110. In this embodiment, an angle $\theta_2$ formed between lines interconnecting the two second position-limiting elements 140 with the axis 116 is substantially less than or equal to 180°.

When one of the first protrusions 162 is aligned with one of the recesses 120 that are located in the two opposite ends of the first area 114*a*, one of the two positioning elements 180 is abutted against one of the two second position-limiting elements 140 to restrict further rotation of the first assembly member 100*a* relative to the second assembly member 100*b* in a direction. In other words, when one of the two positioning elements 180 abuts against a lateral wall 140*a* of one of the second position-limiting elements 140, the two positioning elements 180 cannot be moved further toward the one of the second position-limiting elements 140, and the first elastic elements 160 cannot rotate toward the opposite one of the second position-limiting elements 140. Therefore, when the first assembly member 100*a* is rotated relative to the second assembly member 100*b* in this manner, a lighting angle of the lighting tube 200 (see FIG. 1) may be adjusted.

When the first elastic elements 160 are positioned adjacent to an equal number of the recesses 120, the first protrusions 162 of the first elastic elements 160 are received in these recesses 120 for strengthening the assembly stability between the first assembly member 100*a* and the second assembly member 100*b*. Moreover, the second elastic element 170 is disposed adjacent to one of the recesses 120 and the second protrusion 172 of the second elastic element 170 is received in the one of the recesses 120 for further strengthening the assembly stability between the first assembly member 100*a* and the second assembly member 100*b*. Therefore, after the first assembly member 100*a* is rotated at an angle relative to the second assembly member 100*b*, the first elastic elements 160 and the second elastic element 170 are secured with a number of the recesses 120 such that the first assembly member 100*a* is steadily secured with the second assembly member 100*b* to form the end cap 100 that is rotatable.

Figure 8:
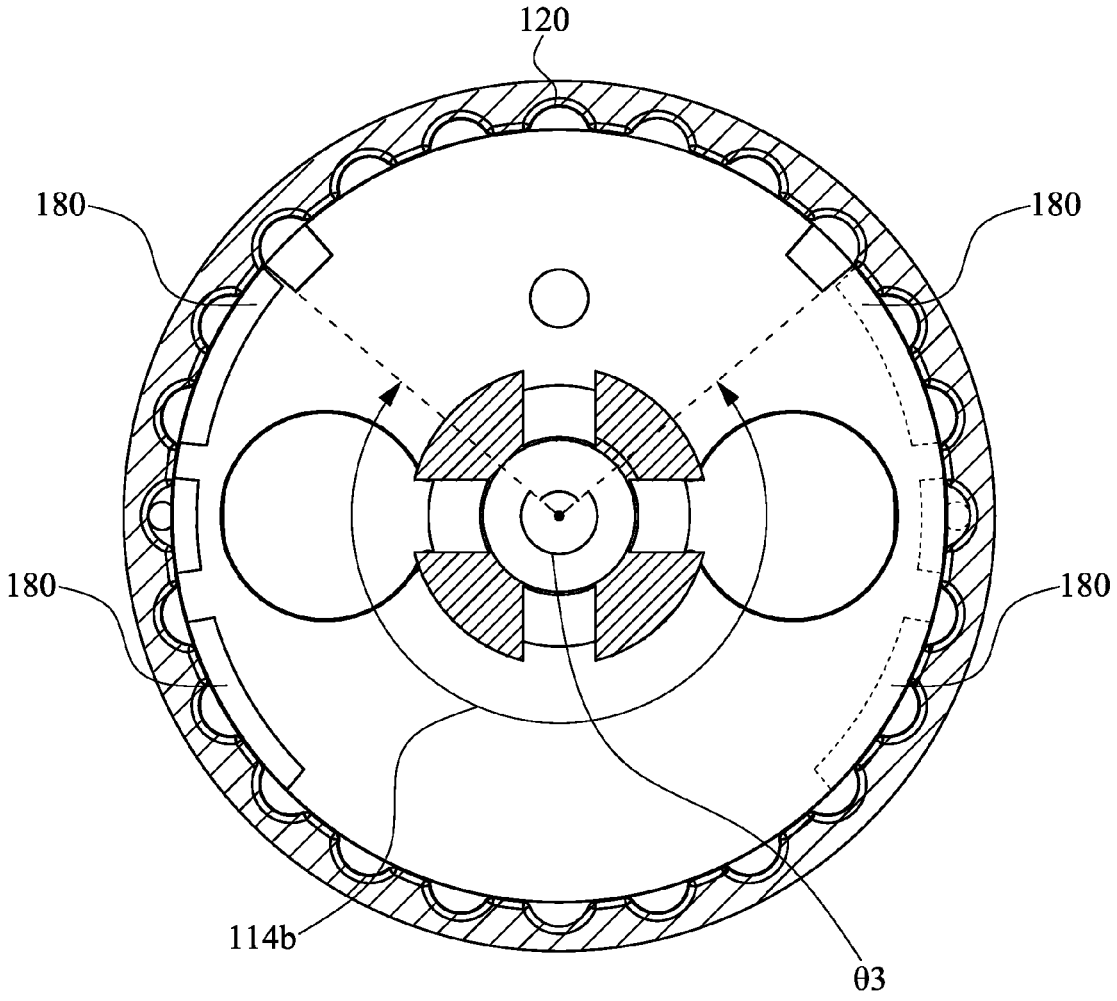
FIG. 8 illustrates a schematic view of a rotating angle range of two positioning elements of the end cap located within a second area according to an embodiment of the present invention.

FIG. 8 shows a schematic view of a rotating angle range of the two positioning elements 180 of the end cap 100 located within the second area 114*b* according to an embodiment of the present invention. In this embodiment, the end cap 100 does not have any second position-limiting elements 140 (see FIG. 7) and the recesses 120 are equally spaced apart along the inner wall of the end cap 100 in the second area 114*b*. Therefore, the rotating angle of the first assembly member 100*a* and the second assembly member 100*b* is more than 180° when the first assembly member 100*a* is secured with the second assembly member 100*b* and the two positioning elements 180 are located in the second area 114*b*.

According to above-described embodiments, the end cap may be assembled as a rotatable end cap or a fixed end cap when the first assembly member is secured with the second assembly member in different assembly configurations. Therefore, the end cap can be used as a rotatable lighting tube or a fixed lighting tube. In addition, the production cost and the assembly complexity of the end cap is low because the first assembly member and the second assembly member have few components.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An end cap of a lighting tube comprising:

a first assembly member comprising:

a first shell having a first central-securing element, an annular inner wall of the first shell forming a first area and a second area;

a plurality of recesses formed in the first area of the annular inner wall of the first shell, an angle formed between two lines each formed from one of two opposite ends of the first area to an axis of the first shell being less than 180°; and two first position-limiting elements respectively disposed on the two ends of the first area; and a second assembly member comprising:

a second shell, one end of the second shell being connected to a lighting tube and the other end of the second shell having a second central-securing element being secured with the first central-securing element such that the first central-securing element is capable of rotating relative to the second central-securing element;

a first elastic element disposed on the second shell, the first elastic element having a first protrusion that is received in one of the recesses;

a second elastic element disposed on the second shell, the second elastic element having a second protrusion that is received in one of the recesses; and two positioning elements disposed on the second shell, the two positioning elements and the first elastic element respectively being disposed on two opposite sides of the second central-securing element.

2. The end cap of claim 1, wherein the angle formed between the two lines each formed from one of the two opposite ends of the first area to the axis of the first shell is 135°.

3. The end cap of claim 1, wherein the first central-securing element has a first hook portion and the second central-securing element has a second hook portion, and the first hook portion is secured with the second hook portion such that the first central-securing element is rotatably secured with the second central-securing element.

4. The end cap of claim 1, wherein the second elastic element is located between the two positioning elements.

5. The end cap of claim 4, wherein a vertical height of each of the positioning elements is greater than a vertical height of the first elastic element and a vertical height of the second elastic element.

6. The end cap of claim 4, wherein the vertical height of the first elastic element is equal to the vertical height of the second elastic element.

7. The end cap of claim 1, wherein a gap is formed between the first elastic element and one of the two first position-limiting elements when the first assembly member is secured with the second assembly member and the first elastic element is aligned with the one of the two first position-limiting elements.

8. The end cap of claim 1, wherein the first assembly member has two second position-limiting elements, and one of the two positioning elements is abutted against one of the two second position-limiting elements to restrict rotation of the first assembly member relative to the second assembly member about a direction when the first protrusion is received in one of the recesses located in the two opposite ends of the first area.

9. The end cap of claim 1, wherein the first shell has an opening, and the maximum vertical distance between one of the recesses and the opening is less than the minimum vertical distance between one of the first position-limiting elements and the opening.

10. The end cap of claim 1, wherein the first assembly member is locked in the second assembly member such that the first assembly member cannot rotate relative to the second assembly member when the first assembly member is secured with the second assembly member and the two positioning elements are abutted against the second position-limiting elements.

11. The end cap of claim 1, wherein a rotating angle of the first assembly member rotates relative to the second assembly member is less than or equal to 180° when the first assembly member is secured with the second assembly member and the two positioning elements are located in the second area.

12. The end cap of claim 1, wherein the rotating angle of the first assembly member rotates relative to the second assembly member is more than 180° when the first assembly member is secured with the second assembly member and the two positioning elements are located in the second area.

* * * * *